US009263244B2

(12) United States Patent
Green et al.

(10) Patent No.: US 9,263,244 B2
(45) **Date of Patent: *Feb. 16, 2016**

(54) MASS SPECTROMETER

(71) Applicant: Micromass UK Limited, Manchester (GB)

(72) Inventors: Martin Raymond Green, Bowdon (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/631,959

(22) Filed: Feb. 26, 2015

(65) Prior Publication Data

US 2015/0170896 A1 Jun. 18, 2015

Related U.S. Application Data

(63) Continuation of application No. 14/080,301, filed on Nov. 14, 2013, now Pat. No. 8,969,799, which is a continuation of application No. 12/518,173, filed as application No. PCT/GB2007/004732 on Dec. 10, 2007, now Pat. No. 8,598,518.

(60) Provisional application No. 60/884,476, filed on Jan. 11, 2007.

(30) Foreign Application Priority Data

Dec. 8, 2006 (GB) ..... 0624535.1
Dec. 10, 2007 (GB) ..... 0724102.9

(51) Int. Cl.
*H01J 49/06* (2006.01)
*H01J 49/40* (2006.01)
*H01J 49/00* (2006.01)

(52) U.S. Cl.
CPC ..... *H01J 49/40* (2013.01); *H01J 49/004* (2013.01); *H01J 49/005* (2013.01); *H01J 49/062* (2013.01); *H01J 49/063* (2013.01); *H01J 49/065* (2013.01); *H01J 49/066* (2013.01)

(58) Field of Classification Search
CPC ..... H01J 49/40; H01J 49/066; H01J 49/063; H01J 49/065; H01J 49/005; H01J 49/004; H01J 49/062
USPC ..... 250/281–300
See application file for complete search history.

(56) References Cited

U.S. PATENT DOCUMENTS 3,621,242 A 11/1971 Ferguson et al.
6,762,404 B2 * 7/2004 Bateman et al. ..... 250/281
6,794,641 B2 9/2004 Bateman et al.
7,084,398 B2 8/2006 Loboda et al.
7,196,324 B2 3/2007 Verentchikov
8,309,915 B2 11/2012 Mackie et al.
8,384,025 B2 2/2013 Sun et al.

(Continued)

*Primary Examiner* — Jack Berman
(74) *Attorney, Agent, or Firm* — Diederiks & Whitelaw, PLC

(57) ABSTRACT

A mass spectrometer is disclosed comprising a time of flight mass analyser. The time of flight mass analyser comprises an ion guide comprising a plurality of electrodes which are interconnected by a series of resistors forming a potential divider. Ions are confined radially within the ion guide by the application of a two-phase RF voltage to the electrodes. A single phase additional RF voltage is applied across the potential divider so that an inhomogeneous pseudo-potential force is maintained along the length of the ion guide.

20 Claims, 9 Drawing Sheets

(56) References Cited

U.S. PATENT DOCUMENTS

| | | | | |
|---|---|---|---|---|
| 8,389,933 | B2 | 3/2013 | Hoyes | |
| 8,426,802 | B2 | 4/2013 | Giles et al. | |
| 8,598,518 | B2 * | 12/2013 | Green et al. | 250/287 |
| 8,969,799 | B2 * | 3/2015 | Green et al. | 250/287 |
| 2005/0253064 | A1 * | 11/2005 | Loboda et al. | 250/292 |
| 2010/0038530 | A1 | 2/2010 | Giles et al. | |
| 2013/0068944 | A1 | 3/2013 | Raptakis et al. | |
| 2014/0061457 | A1 | 3/2014 | Berdnikov et al. | |

* cited by examiner

MASS SPECTROMETER

CROSS REFERENCE TO RELATED APPLICATIONS

This application is a continuation of U.S. patent application Ser. No. 14/080,301 filed Nov. 14, 2013 which is a continuation of U.S. patent application Ser. No. 12/518,173 filed Aug. 26, 2010, now U.S. Pat. No. 8,598,518 issued on Dec. 3, 2013, which is the National Stage of International Application No. PCT/GB2007/004732, filed Dec. 10, 2007, which claims priority to and benefit of United Kingdom Patent Application No. 0624535.1, filed Dec. 8, 2006, United Kingdom Patent Application No. 0724102.9, filed Dec. 10, 2007 and U.S. Provisional Patent Application Ser. No. 60/884,476, filed Jan. 11, 2007. The entire contents of these applications are incorporated herein by reference.

BACKGROUND OF THE INVENTION

The present invention relates to a mass spectrometer and a method of mass spectrometry.

A known mass spectrometer comprises an Electron Impact ("EI") ion source in combination with a reflectron Time of Flight mass analyser. The known reflectron Time of Flight mass analyser comprises a series of ring electrodes which are connected to a potential divider or resistor chain. A RF voltage and a static DC voltage are applied across the ends of the potential divider or resistor chain so that a static axial DC voltage gradient and an inhomogenous axial RF voltage are maintained along the length of the mass analyser. The mass spectrometer further comprises an electron multiplier ion detector which is arranged in line with the central axis of the mass analyser at the position of zero field. At a predetermined phase of the RF voltage applied to the ring electrodes, ions formed by the Electron Impact ion source are pulsed into the Time of Flight mass analyser by applying a voltage pulse to an acceleration grid which is arranged adjacent to an entrance aperture of the mass analyser. Ions which are accelerated into the Time of Flight mass analyser travel a proportion of the length of the mass analyser before being reflected back towards the entrance of the mass analyser. The ions then exit the mass analyser, pass through the acceleration grid and are subsequently detected by the ion detector. The time of flight of the ions from the time that the voltage pulse is applied to the acceleration grid to the subsequent detection of the ions by the ion detector is related to the mass to charge ratio of the ions and the field parameters within the Time of Flight mass analyser.

One problem with the known Time of Flight mass analyser is that ions are not effectively confined radially within the mass analyser. Therefore, the ion transmission efficiency is relatively low.

Another problem with the known Time of Flight mass analyser is that the ions entering the mass analyser have a relatively large spread of initial velocities and initial positions which results in the resolution of the known Time of Flight mass analyser being relatively poor.

A further problem with the known Time of Flight mass analyser is that the mass analyser is only arranged to operate with an Electron Impact ion source which operates at a low pressure and hence the mass analyser is not arranged to operate with an atmospheric pressure ionisation ion source.

It is therefore desired to provide an improved mass spectrometer and method of mass spectrometry.

SUMMARY OF THE INVENTION

According to an aspect of the present invention there is provided a time of flight mass analyser comprising:

an ion guide comprising a plurality of electrodes;

first means arranged and adapted and to confine ions radially within the ion guide; and second means arranged and adapted to apply a time varying inhomogeneous axial electric field along at least a portion of the axial length of the ion guide.

The ion guide preferably comprises: (i) a multipole rod set or a segmented multipole rod set; (ii) an ion tunnel or ion funnel; or (iii) a stack or array of planar, plate or mesh electrodes.

According to an embodiment the multipole rod set preferably comprises a quadrupole rod set, a hexapole rod set, an octapole rod set or a rod set comprising more than eight rods.

According to an embodiment the ion tunnel or ion funnel preferably comprises a plurality of electrodes or at least 2, 5, 10, 20, 30, 40, 50, 60, 70, 80, 90 or 100 electrodes having apertures through which ions are transmitted in use, wherein at least 5%, 10%, 15%, 20%, 25%, 30%, 35%, 40%, 45%, 50%, 55%, 60%, 65%, 70%, 75%, 80%, 85%, 90%, 95% or 100% of the electrodes have apertures which are of substantially the same size or area or which have apertures which become progressively larger and/or smaller in size or in area. Preferably, at least 5%, 10%, 15%, 20%, 25%, 30%, 35%, 40%, 45%, 50%, 55%, 60%, 65%, 70%, 75%, 80%, 85%, 90%, 95% or 100% of the electrodes have internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

The stack or array of planar, plate or mesh electrodes preferably comprises a plurality or at least 2, 3, 4, 5, 6, 7, 8, 9, 10, 11, 12, 13, 14, 15, 16, 17, 18, 19 or 20 planar, plate or mesh electrodes wherein at least 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are arranged generally in the plane in which ions travel in use. Preferably, at least some or at least 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are supplied with an AC or RF voltage and wherein adjacent planar, plate or mesh electrodes are supplied with opposite phases of the AC or RF voltage.

The ion guide preferably comprises a plurality of axial segments or at least 5, 10, 15, 20, 25, 30, 35, 40, 45, 50, 55, 60, 65, 70, 75, 80, 85, 90, 95 or 100 axial segments.

The centre to centre spacing between adjacent electrodes is preferably selected from the group consisting of: (i) <0.5 mm; (ii) 0.5-1.0 mm; (iii) 1.0-1.5 mm; (iv) 1.5-2.0 mm; (v) 2.0-2.5 mm; (vi) 2.5-3.0 mm; (vii) 3.0-3.5 mm; (viii) 3.5-4.0 mm; (ix) 4.0-4.5 mm; (x) 4.5-5.0 mm; (xi) 5.0-5.5 mm; (xii) 5.5-6.0 mm; (xiii) 6.0-6.5 mm; (xiv) 6.5-7.0 mm; (xv) 7.0-7.5 mm; (xvi) 7.5-8.0 mm; (xvii) 8.0-8.5 mm; (xviii) 8.5-9.0 mm; (xix) 9.0-9.5 mm; (xx) 9.5-10.0 mm; and (xxi) >10.0 mm.

The ion guide preferably has an axial length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; (xi) 200-220 mm; (xii) 220-240 mm; (xiii) 240-260 mm; (xiv) 260-280 mm; (xv) 280-300 mm; and (xvi) >300 mm.

The first means preferably comprises first AC or RF voltage means arranged and adapted to apply a first AC or RF voltage to at least 5%, 10%, 15%, 20%, 25%, 30%, 35%, 40%, 45%, 50%, 55%, 60%, 65%, 70%, 75%, 80%, 85%, 90%, 95% or 100% of the electrodes forming the ion guide in order to confine ions radially within the ion guide.

The first AC or RF voltage means is preferably arranged and adapted to supply a first AC or RF voltage to the electrodes of the ion guide having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The first AC or RF voltage means is preferably arranged and adapted to supply a first AC or RF voltage to the electrodes of the ion guide having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The phase difference of the first AC or RF voltage between adjacent electrodes or adjacent groups of electrodes is preferably selected from the group consisting of: (i) >0°; (ii) 1-30°; (iii) 30-60°; (iv) 60-90°; (v) 90-120°; (vi) 120-150°; (vii) 150-180°; (viii) 180°; (ix) 180-210°; (x) 210-240°; (xi) 240-270°; (xii) 270-300°; (xiii) 300-330°; and (xiv) 330-360°.

The first AC or RF voltage applied, in use, to the electrodes preferably causes or generates a radial pseudo-potential well which acts to confine ions radially, in use, within the ion guide.

The first AC or RF voltage preferably comprises a two-phase or multi-phase AC or RF voltage.

According to an embodiment the second means is preferably arranged and adapted to apply a non-zero time varying inhomogeneous axial electric field along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide.

The second means preferably comprises means for applying a second AC or RF voltage to the electrodes. The second AC or RF voltage preferably comprises a single phase AC or RF voltage. The phase difference of the second AC or RF voltage between adjacent electrodes or adjacent groups of electrodes is preferably substantially 0°.

According to the preferred embodiment the second AC or RF voltage is preferably applied across at least some of the plurality of electrodes. The second AC or RF voltage is preferably applied to at least x electrodes, wherein x is selected from the group consisting of: (i) <10; (ii) 10-20; (iii) 20-30; (iv) 30-40; (v) 40-50; (vi) 50-60; (vii) 60-70; (viii) 70-80; (ix) 80-90; (x) 90-100; (xi) 100-150; (xii) 150-200; and (xiii) >200.

In a mode of operation the maximum amplitude of the second AC or RF voltage at one or more points along the axial length of the ion guide is preferably arranged to remain substantially constant with time. According to an alternative mode of operation the maximum amplitude of the second AC or RF voltage at one or more points along the axial length of the ion guide may be arranged to vary, increase or decrease with time.

Preferably, at least 5%, 10%, 15%, 20%, 25%, 30%, 35%, 40%, 45%, 50%, 55%, 60%, 65%, 70%, 75%, 80%, 85%, 90%, 95% or 100% of the plurality of electrodes are connected at different points along a potential divider or resistor chain.

The second means is preferably arranged and adapted to apply a time varying axial electric field along at least a portion of the axial length of the ion guide. The axial electric field preferably increases or decreases along the length of the ion guide in a direction from an ion entrance region of the ion guide to an ion exit region of the ion guide. The axial electric field is preferably arranged to increase or decrease in a linear or non-linear manner along the length of the ion guide in a direction from an ion entrance region of the ion guide to an ion exit region of the ion guide.

According to the preferred embodiment the second means is preferably arranged and adapted to accelerate or decelerate ions axially along at least a portion of the axial length of the ion guide.

According to a less preferred embodiment the second means may further comprise one or more auxiliary electrodes. The one or more auxiliary electrodes are preferably located external to the plurality of electrodes forming the ion guide.

The one or more auxiliary electrodes preferably have a cross-sectional area or shape which preferably varies, increases or decreases along the length of the ion guide in a direction from an ion entrance region of the ion guide to an ion exit region of the ion guide.

The one or more auxiliary electrodes are preferably axially segmented.

According to an embodiment singly charged ions having a mass to charge ratio in the range of 1-100, 100-200, 200-300, 300-400, 400-500, 500-600, 600-700, 700-800, 800-900, 900-1000 or >1000 have a drift or transit time through the ion guide in the range: (i) 0-50 μs; (ii) 50-100 μs; (iii) 100-150 μs; (iv) 150-200 μs; (v) 200-250 μs; (vi) 250-300 μs; (vii) 300-350 μs; (viii) 350-400 μs; (ix) 400-450 μs; (x) 450-500 μs; (xi) 500-550 μs; (xii) 550-600 μs; (xiii) 600-650 μs; (xiv) 650-700 μs; (xv) 700-750 μs; (xvi) 750-800 μs; (xvii) 800-850 μs; (xviii) 850-900 μs; (xix) 900-950 μs; (xx) 950-1000 μs; and (xxi) >1000 μs.

According to an embodiment singly charged ions having a mass to charge ratio in the range of 1-100, 100-200, 200-300, 300-400, 400-500, 500-600, 600-700, 700-800, 800-900, 900-1000 or >1000 have a drift or transit time through the ion guide in the range: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9 ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) 21-22 ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; (xxxi) 30-35 ms; (xxxii) 35-40 ms; (xxxiii) 40-45 ms; (xxxiv) 45-50 ms; (xxxv) 50-55 ms; (xxxvi) 55-60 ms; (xxxvii) 60-65 ms; (xxxviii) 65-70 ms; (xxxix) 70-75 ms; (xl) 75-80 ms; (xli) 80-85 ms; (xlii) 85-90 ms; (xliii) 90-95 ms; (xliv) 95-100 ms; and (xlv) >100 ms.

According to an embodiment the time of flight mass analyser may further comprise DC voltage means for maintaining a substantially constant DC voltage gradient along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide in order to urge at least some ions along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide.

According to an embodiment the time of flight mass analyser may further comprise transient DC voltage means arranged and adapted to apply one or more transient DC voltages or potentials or one or more transient DC voltage or potential waveforms to at least some of the electrodes forming the ion guide in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide.

According to an embodiment the time of flight mass analyser may further comprise AC or RF voltage means arranged and adapted to apply two or more phase-shifted AC or RF voltages to electrodes forming the ion guide in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide.

The time of flight mass analyser preferably comprises a reflectron time of flight mass analyser wherein in a mode of operation ions travel in a first direction, are reflected within the ion guide and then travel in a second direction which is preferably substantially opposed to the first direction.

In a mode of operation ions preferably enter the ion guide via an entrance electrode, entrance region or entrance aperture and preferably traverse the length of the ion guide and preferably exit the ion guide via an exit electrode, exit region or exit aperture.

According to an embodiment ions are preferably not substantially reflected axially within the ion guide as they traverse from the entrance electrode, entrance region or entrance aperture to the exit electrode, exit region or exit aperture.

According to an embodiment at least a portion of the ion guide is arranged to be maintained at a pressure selected from the group consisting of: (i) >0.001 mbar; (ii) >0.01 mbar; (iii) >0.1 mbar; (iv) >1 mbar; (v) >10 mbar; (vi) >100 mbar; (vii) 0.001-100 mbar; (viii) 0.01-10 mbar; and (ix) 0.1-1 mbar.

According to an embodiment at least a portion of the ion guide is arranged to be maintained at a pressure selected from the group consisting of: (i) 0.001-0.005 mbar; (ii) 0.005-0.010 mbar; (iii) 0.01-0.05 mbar; (iv) 0.05-0.10 mbar; (v) 0.1-0.5 mbar; (vi) 0.5-1.0 mbar; (vii) 1-5 mbar; (viii) 5-10 mbar; (ix) 10-50 mbar; (x) 50-100 mbar; and (xi) >100 mbar.

In a mode of operation ions are preferably substantially separated according to their mass to charge ratio without ions being substantially separated according to their ion mobility.

In a mode of operation ions are preferably substantially separated according to their mass to charge ratio and/or their ion mobility.

In a mode of operation the mass analyser is preferably arranged and adapted to operate as a collision, fragmentation or reaction device.

In a mode of operation the mass analyser is preferably arranged and adapted to collisionally cool or thermalise ions within the ion guide.

In a mode of operation the mass analyser is preferably arranged and adapted to operate as an ion mobility spectrometer or separator.

In a mode of operation ions are preferably arranged to pass through the ion guide in a first direction and a collision, background or other gas is arranged to flow through the ion guide in a second direction. The first direction may be substantially opposed to the second direction. Alternatively, the first direction may be substantially the same direction as the second direction.

According to another aspect of the present invention there is provided a mass spectrometer comprising a time of flight mass analyser as disclosed above.

The mass spectrometer preferably further comprises an acceleration electrode, pusher electrode, puller electrode or grid electrode wherein in a mode of operation ions are preferably accelerated into the ion guide by applying a voltage pulse to the acceleration electrode, pusher electrode, puller electrode or grid electrode. The acceleration electrode, pusher electrode, puller electrode or grid electrode is preferably arranged adjacent an entrance electrode, entrance region or entrance aperture of the ion guide.

The mass spectrometer preferably further comprises an ion detector arranged adjacent the entrance electrode, entrance region or entrance aperture of the ion guide. Alternatively, the ion detector may be arranged adjacent an exit electrode, exit region or exit aperture of the ion guide, wherein the exit electrode, exit region or exit aperture is arranged at an opposite end of the ion guide to the entrance electrode, entrance region or entrance aperture.

The mass spectrometer preferably further comprises an further ion guide, ion trap or ion trapping region arranged upstream and/or downstream of the time of flight mass analyser. The further ion guide, ion trap or ion trapping region is preferably arranged to trap, store or accumulate ions and then to periodically pulse ions into or towards the time of flight mass analyser.

In a mode of operation the maximum amplitude of the second AC or RF voltage at one or more points along the axial length of the ion guide forming part of the time of flight mass analyser is preferably arranged to vary, increase or decrease with time in a synchronised manner with the release of ions from the further ion guide, ion trap or ion trapping region arranged upstream and/or downstream of the time of flight mass analyser.

The mass spectrometer may further comprise a second ion guide comprising a plurality of electrodes. The second ion guide is preferably arranged upstream and/or downstream of the time of flight mass analyser. The second ion guide preferably comprises: (i) a multipole rod set or a segmented multipole rod set; (ii) an ion tunnel or ion funnel; or (iii) a stack or array of planar, plate or mesh electrodes.

According to an embodiment the multipole rod set comprises a quadrupole rod set, a hexapole rod set, an octapole rod set or a rod set comprising more than eight rods.

According to an embodiment the ion tunnel or ion funnel comprises a plurality of electrodes or at least 2, 5, 10, 20, 30, 40, 50, 60, 70, 80, 90 or 100 electrodes having apertures through which ions are transmitted in use, wherein at least 5%, 10%, 15%, 20%, 25%, 30%, 35%, 40%, 45%, 50%, 55%, 60%, 65%, 70%, 75%, 80%, 85%, 90%, 95% or 100% of the electrodes have apertures which are of substantially the same size or area or which have apertures which become progressively larger and/or smaller in size or in area. Preferably, at least 5%, 10%, 15%, 20%, 25%, 30%, 35%, 40%, 45%, 50%, 55%, 60%, 65%, 70%, 75%, 80%, 85%, 90%, 95% or 100% of the electrodes have internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

According to an embodiment the stack or array of planar, plate or mesh electrodes comprises a plurality or at least 2, 3, 4, 5, 6, 7, 8, 9, 10, 11, 12, 13, 14, 15, 16, 17, 18, 19 or 20 planar, plate or mesh electrodes wherein at least 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are arranged generally in the plane in which ions travel in use. Preferably, at least some or at least 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are supplied with an AC or RF voltage and wherein adjacent planar, plate or mesh electrodes are supplied with opposite phases of the AC or RF voltage.

The second ion guide preferably comprises a plurality of axial segments or at least 5, 10, 15, 20, 25, 30, 35, 40, 45, 50, 55, 60, 65, 70, 75, 80, 85, 90, 95 or 100 axial segments.

The centre to centre spacing between adjacent electrodes of the second ion guide is preferably selected from the group consisting of: (i) <0.5 mm; (ii) 0.5-1.0 mm; (iii) 1.0-1.5 mm; (iv) 1.5-2.0 mm; (v) 2.0-2.5 mm; (vi) 2.5-3.0 mm; (vii) 3.0-3.5 mm; (viii) 3.5-4.0 mm; (ix) 4.0-4.5 mm; (x) 4.5-5.0 mm; (xi) 5.0-5.5 mm; (xii) 5.5-6.0 mm; (xiii) 6.0-6.5 mm; (xiv) 6.5-7.0 mm; (xv) 7.0-7.5 mm; (xvi) 7.5-8.0 mm; (xvii) 8.0-8.5 mm; (xviii) 8.5-9.0 mm; (xix) 9.0-9.5 mm; (xx) 9.5-10.0 mm; and (xxi) >10.0 mm.

The second ion guide preferably has an axial length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; (xi) 200-220 mm; (xii) 220-240 mm; (xiii) 240-260 mm; (xiv) 260-280 mm; (xv) 280-300 mm; and (xvi) >300 mm.

According to an embodiment the mass spectrometer further comprises DC voltage means for maintaining a substantially constant DC voltage gradient along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the second ion guide in order to urge at least some ions along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the second ion guide.

According to an embodiment the mass spectrometer comprises transient DC voltage means arranged and adapted to apply one or more transient DC voltages or potentials or one or more transient DC voltage or potential waveforms to at least some of the electrodes forming the second ion guide in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the second ion guide.

According to an embodiment the mass spectrometer further comprises AC or RF voltage means arranged and adapted to apply two or more phase-shifted AC or RF voltages to electrodes forming the second ion guide in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the second ion guide.

According to an embodiment the mass spectrometer further comprises a second mass analyser arranged upstream and/or downstream of the time of flight mass analyser. The second mass analyser is preferably selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; (xiv) an axial acceleration Time of Flight mass analyser; and (xv) a Wein filter.

According to an embodiment the mass spectrometer further comprises a collision, fragmentation or reaction device. The collision, fragmentation or reaction device is preferably arranged and adapted to fragment ions by Collision Induced Dissociation ("CID"). According to an alternative embodiment the collision, fragmentation or reaction device is selected from the group consisting of: (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

According to an embodiment the mass spectrometer further comprises acceleration means arranged and adapted to accelerate ions into the collision, fragmentation or reaction device wherein in a mode of operation at least 5%, 10%, 15%, 20%, 25%, 30%, 35%, 40%, 45%, 50%, 55%, 60%, 65%, 70%, 75%, 80%, 85%, 90%, 95% or 100% of the ions are caused to fragment or react upon entering the collision, fragmentation or reaction device.

According to an embodiment the mass spectrometer further comprises a control system arranged and adapted to switch or repeatedly switch the potential difference through which ions pass prior to entering the collision, fragmentation or reaction device between a relatively high fragmentation or reaction mode of operation wherein ions are substantially fragmented or reacted upon entering the collision, fragmentation or reaction device and a relatively low fragmentation or reaction mode of operation wherein substantially fewer ions are fragmented or reacted or wherein substantially no ions are fragmented or reacted upon entering the collision, fragmentation or reaction device. In the relatively high fragmentation or reaction mode of operation ions entering the collision, fragmentation or reaction device are preferably accelerated through a potential difference selected from the group consisting of: (i) ≥10 V; (ii) ≥20 V; (iii) ≥30 V; (iv) ≥40 V; (v) ≥50 V; (vi) ≥60 V; (vii) ≥70 V; (viii) ≥80 V; (ix) ≥90 V; (x) ≥100 V; (xi) ≥110 V; (xii) ≥120 V; (xiii) ≥130 V; (xiv) ≥140 V; (xv) ≥150 V; (xvi) ≥160 V; (xvii) ≥170 V; (xviii) ≥180 V; (xix) ≥190 V; and (xx) ≥200 V. In the relatively low fragmentation or reaction mode of operation ions entering the collision, fragmentation or reaction device are preferably accelerated through a potential difference selected from the group consisting of: (i) ≤20 V; (ii) ≤15 V; (iii) ≤10 V; (iv) ≤5V; and (v) ≤1V. The control system is preferably arranged and adapted to switch the collision, fragmentation or reaction device between the relatively high fragmentation or reaction mode of operation and the relatively low fragmentation or reaction mode of operation at least once every 1 ms, 5 ms, 10 ms, 15 ms, 20 ms, 25 ms, 30 ms, 35 ms, 40 ms, 45 ms, 50 ms, 55 ms, 60 ms, 65 ms, 70 ms, 75 ms, 80 ms, 85 ms, 90 ms, 95 ms, 100 ms, 200 ms, 300 ms, 400 ms, 500 ms, 600 ms, 700 ms, 800 ms, 900 ms, 1 s, 2 s, 3 s, 4 s, 5 s, 6 s, 7 s, 8 s, 9 s or 10 s.

The collision, fragmentation or reaction device is preferably arranged and adapted to receive a beam of ions and to convert or partition the beam of ions such that at least 1, 2, 3, 4, 5, 6, 7, 8, 9, 10, 11, 12, 13, 14, 15, 16, 17, 18, 19 or 20 separate groups or packets of ions are confined and/or isolated in the collision, fragmentation or reaction device at any particular time, and wherein each group or packet of ions is separately confined and/or isolated in a separate axial potential well formed in the collision, fragmentation or reaction device.

According to an embodiment the mass spectrometer further comprises a further mass filter or mass analyser arranged upstream and/or downstream of the time of flight mass analyser. The further mass filter or mass analyser is preferably selected from the group consisting of: (i) a quadrupole rod set mass filter; (ii) a Time of Flight mass filter or mass analyser; (iii) a Wein filter; and (iv) a magnetic sector mass filter or mass analyser.

According to an embodiment the mass spectrometer further comprises an ion source. The ion source is preferably selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) a Thermospray ion source; (xviii) a Particle Beam ("PB") ion source; and (xix) a Flow Fast Atom Bombardment ("Flow FAB") ion source.

The mass spectrometer preferably further comprises a continuous or pulsed ion source.

According to another aspect of the present invention there is provided a method of mass analysing ions according to their time of flight comprising:

providing an ion guide comprising a plurality of electrodes;

confining ions radially within the ion guide; and applying a time varying inhomogeneous axial electric field along at least a portion of the axial length of the ion guide.

According to another aspect of the present invention there is provided a method of mass spectrometry comprising a method as disclosed above.

According to another aspect of the present invention there is provided a device for temporally separating ions according to their mass to charge ratio and/or ion mobility, the device comprising:

an ion guide comprising a plurality of electrodes;

first means arranged and adapted and to confine ions radially within the ion guide; and second means arranged and adapted to apply a time varying inhomogeneous axial electric field along at least a portion of the axial length of the ion guide.

According to another aspect of the present invention there is provided a method of temporally separating ions according to their mass to charge ratio and/or ion mobility, the device comprising:

providing an ion guide comprising a plurality of electrodes;

confining ions radially within the ion guide; and applying a time varying inhomogeneous axial electric field along at least a portion of the axial length of the ion guide.

The preferred embodiment relates to a mass spectrometer or mass analyser comprising an RF ion guide. The RF ion guide preferably comprises a ring stack ion guide wherein an AC or RF voltage is applied to neighbouring ring electrodes. The AC or RF voltage which is applied to the ring electrodes is preferably such that the same amplitude AC or RF voltage is applied to neighbouring electrodes but the phase of the AC or RF voltage is preferably 180 degrees different between two neighbouring electrodes. Therefore, according to the preferred embodiment adjacent electrodes are preferably supplied with opposite phases of the AC or RF voltage. The AC or RF voltage applied to the electrodes preferably results in a radial pseudo-potential well being formed or generated which preferably acts to contain or confine ions radially within the ion guide.

A supplemental, secondary or additional AC, RF or time varying inhomogeneous electric field is preferably additionally applied or maintained along at least part of or substantially the whole length of the axial length of the ion guide. The resulting axial inhomogenous AC, RF or time varying electric field preferably acts to propel, force or urge ions in a particular direction along the length of the ion guide.

The supplemental, secondary or additional AC or RF or time varying voltage is preferably applied or maintained across the axial length of the ion guide such that preferably all the electrodes forming the ion guide experience the same phase of the supplemental, secondary or additional AC, RF or time varying voltage i.e. there is a zero phase difference between the electrodes. However, the amplitude of the supplemental, secondary or additional AC, RF or time varying voltage is preferably arranged to increase or decrease along the length of the ion guide. According to a preferred embodiment the amplitude varies in a nonlinear manner.

The axial pseudo-potential force preferably urges ions in a direction so that ions move towards a region of weakest axial pseudo-potential force. The axial pseudo-potential force experienced by an ion is preferably inversely proportional to the mass to charge ratio of the ion.

According to the preferred embodiment the ion guide comprises a plurality of ring electrodes. This embodiment is particularly advantageous since different AC or RF voltages can be applied to different axial segments. However, according to other less preferred embodiments the ion guide may comprise an elongated RF multipole rod set ion guide such as a quadrupole rod set ion guide, a hexapole rod set ion guide or an octopole rod set ion guide. No axial electric field is developed as a result of applying an AC or RF voltage to the rod electrodes in order to confine ions radially within the rod set ion guide.

According to another embodiment the multipole rod set ion guide may be axially segmented thereby enabling a supplemental, secondary or additional AC, RF or time varying voltage to be applied individually to the axial segments so that a non-zero axial inhomogenous pseudo-potential force is preferably generated along the length of the ion guide.

According to another embodiment, one or more auxiliary shaped electrodes may be used to create an axial pseudo-potential driving force. The one or more auxiliary electrodes may be located external to the multipole rod electrodes. The one or more auxiliary electrodes may be supplied with a supplemental, secondary or additional AC, RF or time varying voltage which is preferably independent of the AC or RF voltage which is preferably applied to the multipole rod electrodes in order to confine ions radially within the ion guide. The one or more auxiliary electrodes may be situated between the rod electrodes in regions of zero potential. The one or more auxiliary electrodes may be shaped to produce the required axial field. According to another embodiment the one or more auxiliary electrodes may be segmented axially so that different amplitudes of the supplemental, secondary or additional AC or RF voltage may be applied to individual segments.

According to an embodiment a DC voltage may additionally be applied to the one or more auxiliary electrodes so that a smoothly varying potential or a travelling wave voltage or potential may be created which preferably manipulates or urges ion populations within the ion guide and which preferably translates ions along the length of and through the ion guide.

According to another less preferred embodiment the RF ion guide may comprise a segmented flat plate ion guide comprising a plurality of plate electrodes. The plate electrodes forming the ion guide may be arranged in a sandwich formation with the plane of the plates arranged parallel to the axis of the ion guide. An AC or RF voltage is preferably applied between neighbouring plates in order to confine ions within the ion guide. The plates are preferably axially segmented such that different AC or RF voltages can be applied to different axial segments of the ion guide so that an axial non-zero AC or RF electric field may be maintained along the length of the ion guide.

An ion guide or mass analyser according to various embodiments of the present invention is particularly advantageous since the AC or RF voltage or potential which is applied to the electrodes forming the ion guide in order to confine ions radially within the ion guide can be adjusted so that ions are confined radially within the ion guide in a substantially optimum manner. The radial confinement of ions can be arranged and optimised in a manner which is essentially independent of applying or generating an axial pseudo-potential driving force along the length of the ion guide or mass analyser. An ion guide or mass analyser according to the preferred embodiment can therefore be optimised for a number of different applications.

Another advantage of the ion guide or mass analyser according to various embodiments of the present invention is that the preferred ion guide or mass analyser can be coupled to an atmospheric pressure ionisation source.

BRIEF DESCRIPTION OF THE DRAWINGS

Various embodiments of the present invention together with an arrangement given for illustrative purposes only will now be described, by way of example only, and with reference to the accompanying drawings in which.

DETAILED DESCRIPTION OF THE PREFERRED EMBODIMENTS

Figure 1:
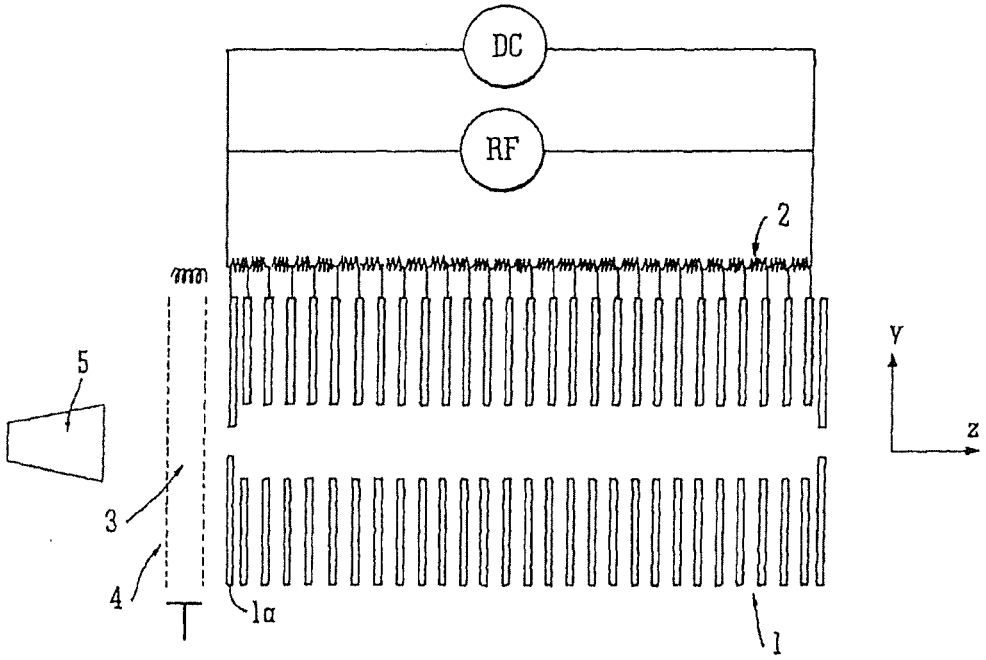
FIG. 1 PRIOR ART
FIG. 1 shows a known reflectron Time of Flight mass analyser.

A known mass spectrometer comprising an Electron Impact ion source and a reflectron Time of Flight mass analyser will now be described, for illustrative purposes only, with reference to FIG. 1. The mass analyser comprises a series of ring electrodes 1 which are interconnected via a resistor chain 2 to both a RF power supply and a DC power supply. The resistor chain is arranged such that the potential applied to a given electrode is given by:

$$U_{z,x,y}(t) = \left(\frac{-1}{z_0^2 - \frac{r_0}{2}}\right)(Vdc + Vac\cos(\Omega t))\left(z^2 - \frac{(x^2+y^2)}{2}\right) \quad (1)$$

wherein $z_0$ is the overall length of the ion guide or Time of Flight mass analyser, $r_0$ is the internal radius of each ring electrode, Vdc is the amplitude of the applied DC voltage, Vac is the amplitude of the applied AC voltage and Q is the frequency of oscillation of the applied AC voltage.

The Electron Impact ("EI") ion source which generates ions is located in a low pressure region. Some of the ions which are generated by the ion source are present in a region 3 adjacent an entrance electrode 1*a* or entrance aperture of the Time of Flight mass analyser. Ions formed by the ion source are periodically accelerated into the Time of Flight mass analyser by applying a voltage pulse to an acceleration grid 4 which is arranged adjacent to the entrance electrode 1*a* or entrance aperture of the Time of Flight mass analyser. Ions are pulsed into the mass analyser and start to travel along the length of the mass analyser. As ions begin to approach the opposite end of the ion guide or Time of Flight mass analyser the ions are reflected back towards the entrance electrode 1*a* and the entrance aperture of the ion guide or mass analyser by the combination of an axial DC voltage gradient (which is maintained along the length of the ion guide or mass analyser) and a time averaged or pseudo-potential force which is also maintained along the length of the ion guide or mass analyser. The axial pseudo-potential force results from the application of an AC or RF voltage which is applied across the length of the ion guide or mass analyser. Ions exit the ion guide or mass analyser via the entrance electrode 1*a* and are then subsequently detected by an ion detector 5. The ion detector 5 is arranged co-axially with the central axis of the ion guide or mass analyser. The arrival time of ions at the ion detector 5 is related to the mass to charge ratio of the ions and the field parameters of the ion guide or mass analyser. Ions are not confined radially within the ion guide or mass analyser as they traverse the length of the ion guide or mass analyser which is maintained at a relatively low pressure.

Figure 2A:
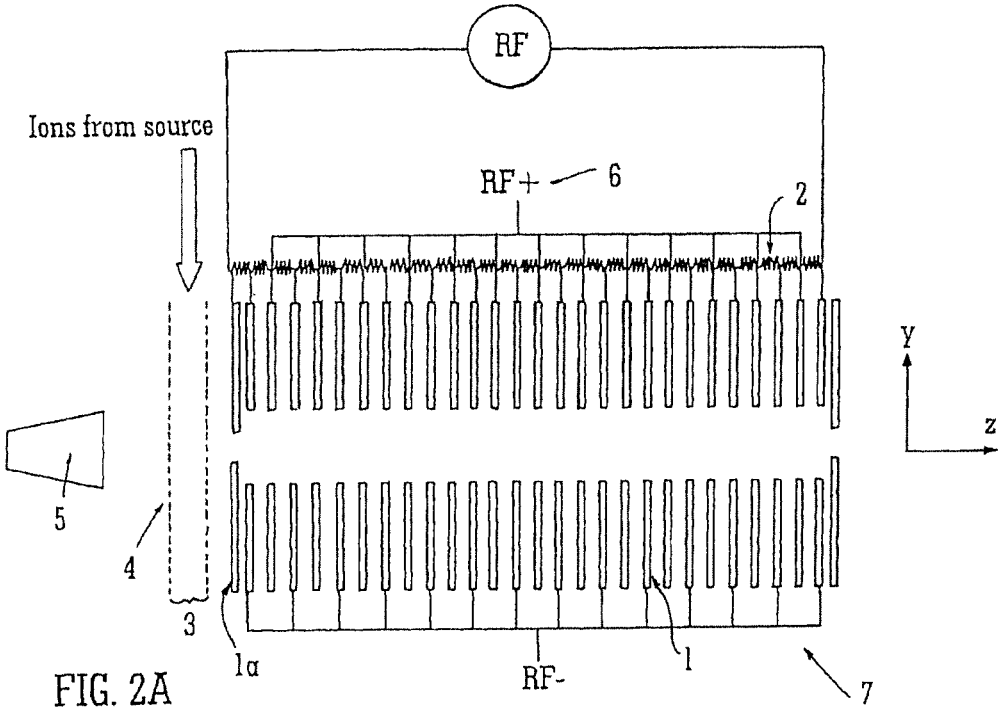
FIG. 2A shows a Time of Flight mass analyser according to an embodiment of the present invention wherein ions enter and exit the mass analyser via an entrance electrode and FIG. 2B shows how the axial pseudo-potential varies along the length of the mass analyser according to an embodiment.

FIG. 2A shows a reflectron Time of Flight ion guide or mass analyser 7 according to an embodiment of the present invention. The ion guide or mass analyser 7 preferably comprises a series or a plurality of ring electrodes 1 or electrodes having apertures through which ions are preferably transmitted in use. The electrodes 1 are preferably connected to a two-phase AC or RF voltage supply 6. Neighbouring electrodes 1 are preferably connected to opposite phases of the two-phase AC or RF voltage supply 6. As a result, a radial pseudo-potential well is preferably produced or created within the ion guide or mass analyser 7 which preferably serves or acts to confine ions radially within the ion guide or mass analyser 7. This is in contrast to the known Time of Flight mass analyser wherein ions are not confined radially within the known Time of Flight mass analyser. The application of the two-phase AC or RF voltage to the electrodes 1 forming the ion guide or mass analyser 7 preferably results in a series of axial pseudo-potential corrugations being formed or created along the length of the ion guide or mass analyser 7. The axial pseudo-potential corrugations preferably have a relatively small amplitude and may have the effect of slowing down or substantially stopping the onward passage of at least some ions through the ion guide or mass analyser 7 in the absence of any axial driving field or force. This effect may be particularly evident in the presence of a buffer gas.

Figure 2B:
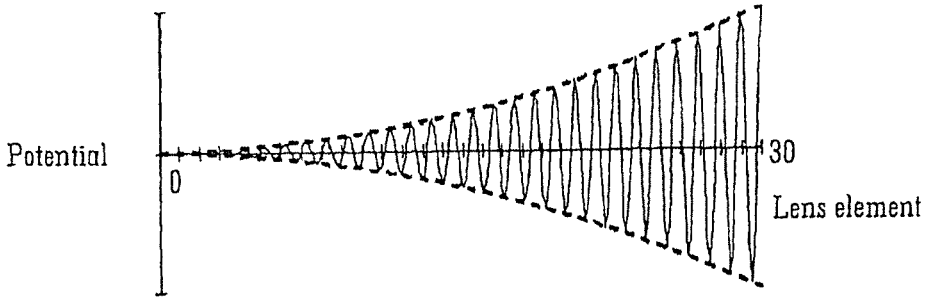

According to the preferred embodiment of the present invention a supplemental, secondary or additional oscillating, AC or RF voltage is preferably applied across the ion guide or mass analyser 7. The supplemental, secondary or additional oscillating, AC or RF voltage is preferably a single phase voltage. The maximum amplitude of the supplemental, secondary or additional oscillating, AC or RF voltage preferably varies along the axial length of the ion guide or mass analyser 7. According to an embodiment the maximum amplitude of the supplemental, secondary or additional oscillating, AC or RF voltage may vary in a non-linear manner as shown in FIG. 2B along the axial length of the ion guide or mass analyser 7.

The general form of the supplemental, secondary or additional oscillating, AC or RF potential $V_n$ applied to a particular electrode 1 or element of the ion guide or mass analyser 7 may be described by:

$$V_n = \epsilon(n)\cos(\sigma t) \tag{2}$$

wherein n is the index number of the electrode, f(n) is a function describing the amplitude of oscillation for the particular electrode and σ is the frequency of modulation of the supplemental, secondary or additional oscillating, AC or RF potential.

If the maximum amplitude of the supplemental, secondary or additional oscillating, AC or RF potential described by f(n) increases away from the entrance electrode 1*a* of the ion guide or mass analyser 7 in a non-linear manner as shown in FIG. 2B towards the opposite end of the ion guide or mass analyser 7, then a mass to charge ratio dependent pseudo-potential ramp will be formed, created or exist along the axial length of the ion guide or mass analyser 7. The pseudo-potential ramp will preferably be superimposed upon the relatively low amplitude regular pseudo-potential axial corrugations which preferably result from the application of the two-phase AC or RF voltage to the electrodes 1 in order to confine ions radially within the ion guide or mass analyser 7.

The axial pseudo-potential ramp preferably has the effect of propelling, directing or urging ions back along the length of the ion guide or mass analyser 7 towards a region of relatively weak axial pseudo-potential force i.e. back towards the entrance electrode 1*a* and the entrance aperture of the ion guide or mass analyser 7. The magnitude of the axial pseudo-potential ramp as experienced by an ion is preferably inversely proportional to the mass to charge ratio of the ion.

According to the preferred embodiment, the ion source which generates ions is not limited to an Electron Impact ion source and may comprise a pulsed ion source or a continuous ion source. According to an embodiment, ions from the ion source may be arranged to arrive at an orthogonal acceleration region 3 which is preferably located adjacent to an entrance electrode 1*a* and the entrance aperture of the ion guide or mass analyser 7. The ions which arrive at the orthogonal acceleration region 3 may comprise a continuous stream of ions or alternatively the ions may be grouped into a series of discrete packets of ions.

As ions arrive at the orthogonal acceleration region 3, ions are preferably periodically orthogonally accelerated into the ion guide or mass analyser 7 by applying a voltage pulse to an acceleration grid 4. The acceleration grid 4 is preferably arranged adjacent to the orthogonal acceleration region 3 and is preferably also in close proximity to the entrance electrode 1*a* and the entrance aperture which leads into the ion guide or mass analyser 7. Ions which are injected into the ion guide or mass analyser 7 are preferably caused to traverse a proportion of the length of the ion guide or mass analyser 7. The ions are then preferably reflected back towards the entrance electrode 1*a* and the entrance aperture by the axial pseudo-potential ramp. The ions then preferably exit the ion guide or mass analyser 7 via the entrance electrode 1*a* and the entrance aperture and preferably pass through the acceleration grid 4. The ions are then preferably detected by an ion detector 5 which is preferably arranged co-axial with the central axis of the ion guide or mass analyser 7. The arrival time of ions at the ion detector 5 is preferably recorded and the arrival time is preferably related in a substantially linear manner to the mass to charge ratio of the ions and the field parameters of the ion guide or mass analyser 7.

As ions traverse the ion guide or mass analyser 7 they are preferably contained or confined radially within the ion guide or mass analyser 7 by a radial pseudo-potential well which preferably results from the application of the two-phase AC or RF voltage to the electrodes 1 of the ion guide or mass analyser 7.

The ion guide or mass analyser 7 according to the preferred embodiment of the present invention may be used with or coupled to a variety of different ionisation sources including an Atmospheric Pressure Ionisation ion source. The ability of being able to couple an Atmospheric Pressure Ionisation ion source to the preferred ion guide or mass analyser 7 is particularly advantageous.

According to an embodiment the amplitude or strength of the radial confining pseudo-potential may be adjusted substantially independently of the amplitude or strength of the axial pseudo-potential ramp. Accordingly, the ion guide or mass analyser 7 is preferably arranged so that ions are preferably radially confined in an optimal manner and at the same time ions are preferably transported along and through the length of the ion guide or mass analyser 7 and separated according to their mass to charge ratio in an efficient and optimal manner.

Figure 3A:
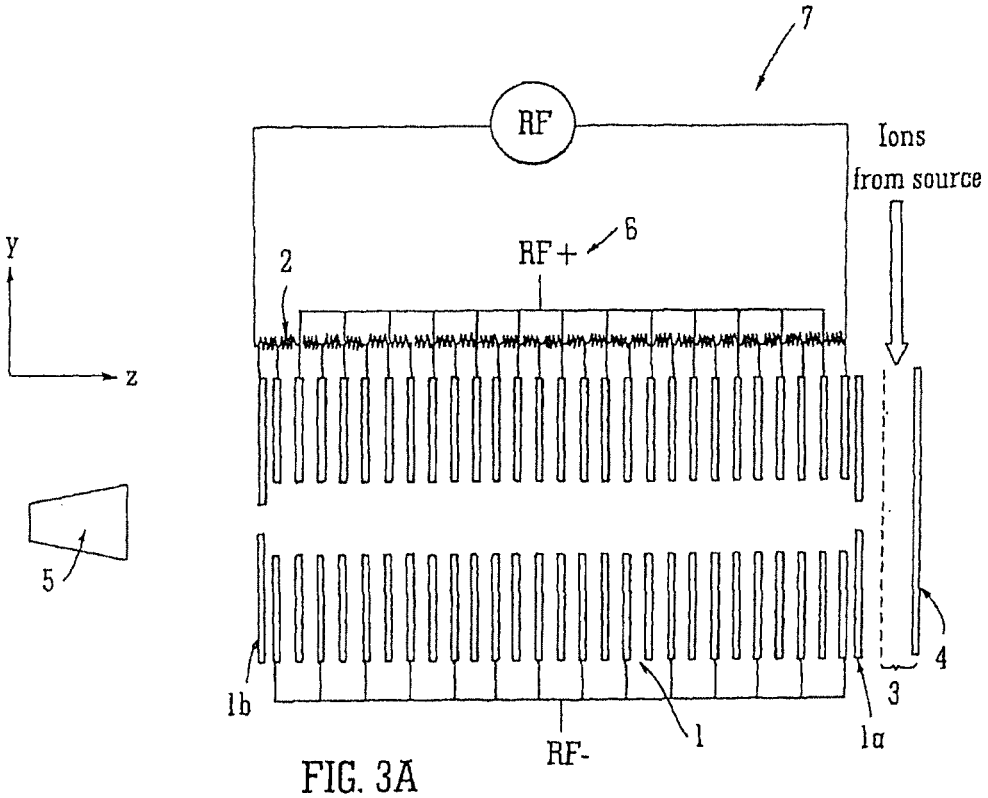
FIG. 3A shows a Time of Flight mass analyser according to another embodiment of the present invention wherein ions enter the mass analyser via an entrance electrode and exit the mass analyser via an exit electrode arranged at the opposite end of the mass analyser and FIG. 3B shows how the axial pseudo-potential varies along the length of the mass analyser according to an embodiment.

An ion guide or Time of Flight mass analyser according to another embodiment of the present invention is shown in FIG. 3A. According to this embodiment, an ion guide or mass analyser 7 is provided wherein ions are not reflected within the ion guide or mass analyser 7. Instead, ions preferably enter the ion guide or mass analyser 7 via an entrance electrode 1*a* and entrance aperture. The ions preferably traverse the length of the ion guide or mass analyser 7 and then preferably exit the ion guide or mass analyser 7 via an exit electrode 1*b* or exit aperture which is preferably located at the opposite end of the ion guide or mass analyser 7 to that of the entrance electrode 1*a* and the entrance aperture. An ion detector 5 is preferably arranged adjacent the exit electrode 1*b* or the exit aperture. The orthogonal acceleration region 3 is therefore preferably arranged at an opposite end of the ion guide or mass analyser 7 to that of the ion detector 5.

A two-phase AC or RF voltage or potential is preferably applied to the electrodes 1 forming the ion guide or mass analyser 7 so that adjacent electrodes are preferably connected to or maintained at opposite phases of the AC or RF voltage or potential. As a result, ions are preferably confined radially within the ion guide or mass analyser 7 by a radial pseudo-potential well. A supplemental, secondary or additional axial driving AC or RF potential is preferably applied or maintained across the length of the ion guide or mass analyser 7. The axial driving AC or RF potential preferably acts to propel, direct or urge ions along the length of the ion guide or mass analyser 7 from the entrance region, entrance electrode 1*a* or entrance aperture of the ion guide or mass analyser 7 towards the exit region, exit electrode 1*b* or exit aperture of the ion guide or mass analyser 7.

Ions present in the orthogonal acceleration region 3 are preferably pulsed into the ion guide or mass analyser 7 at a time T0 by the application of a voltage pulse to an acceleration electrode 4. The acceleration electrode 4 is preferably arranged close to and adjacent the entrance electrode 1*a* or entrance aperture of the ion guide or mass analyser 7. The supplemental, secondary or additional AC or RF potential which is preferably applied to the electrodes 1 may be arranged initially to have a relatively low or zero amplitude. Once ions have entered the ion guide or mass analyser 7 at a subsequent time T1 (wherein T1>T0), the magnitude or amplitude of the supplemental, secondary or additional oscillating, AC or RF potential is preferably increased or switched from a relatively low or zero amplitude to a maximum value or amplitude.

Figure 3B:
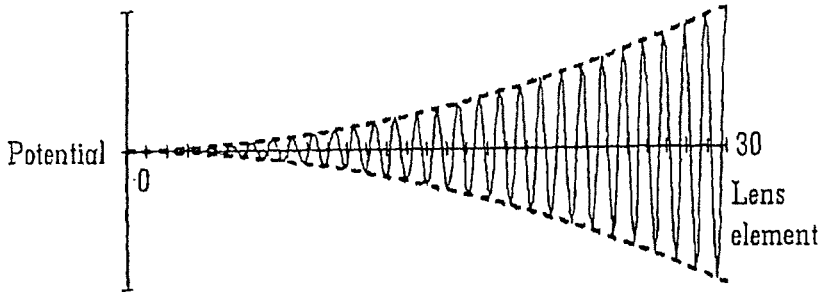

According to an embodiment, the maximum amplitude of the supplemental, secondary or additional oscillating, AC or RF potential is preferably arranged to vary along the length of the ion guide or mass analyser 7 in a manner such that the maximum amplitude preferably decreases along the length of the ion guide or mass analyser 7 from the entrance region, entrance electrode 1*a* or entrance aperture of the ion guide or mass analyser 7 towards the exit region, exit electrode 1*b* or exit aperture of the ion guide or mass analyser 7. The axial pseudo-potential may decrease in a non-linear manner as shown, for example, in FIG. 3B. The axial pseudo-potential ramp is preferably mass to charge ratio dependent. The axial pseudo-potential ramp is preferably superimposed upon relatively low amplitude axial pseudo-potential corrugations which result from the application of the two-phase AC or RF voltage from the AC or RF voltage supply 6 to the electrodes 1 of the ion guide or mass analyser 7. The two-phase AC or RF voltage is preferably applied to the electrodes 1 in order to generate a radial pseudo-potential well which preferably acts to confine ions radially within the ion guide or mass analyser 7. The axial pseudo-potential ramp preferably acts to propel, direct or urge ions along the length of the ion guide or mass analyser 7 from the entrance region, entrance electrode 1*a* or entrance aperture of the ion guide or mass analyser 7 towards the exit region, exit electrode 1*b* or exit aperture of the ion guide or mass analyser 7.

The magnitude of the axial pseudo-potential ramp as experienced by an ion is preferably inversely proportional to the mass to charge ratio of the ion. The depth of the regular axial pseudo-potential corrugations resulting from applying the two-phase AC or RF voltage 6 to the electrodes 1 in order to confine ions radially within the ion guide or mass analyser 7 is also preferably inversely proportional to mass to charge ratio of the ions. According to an embodiment the axial electric field which preferably propels, directs or urges ions along the length of the ion guide or mass analyser 7 may be matched to the depth of the axial pseudo-potential corrugations for all ions irrespective of their mass to charge ratio.

The arrival time of ions which emerge from the ion guide or mass analyser 7 via the exit electrode 1*b* or exit aperture and which then subsequently impinge upon the ion detector 5 are preferably recorded. The ion detector 5 is preferably arranged adjacent the exit electrode 1*b* of the ion guide or mass analyser 7. The arrival time of an ion at the ion detector 5 is preferably related to the mass to charge ratio of the ions and the field parameters of the ion guide or mass analyser 7.

As ions traverse the length of the ion guide or mass analyser 7 the ions are preferably contained radially within the ion guide or mass analyser 7 by a radial pseudo-potential well which is preferably formed or generated by the application of an AC or RF voltage to the electrodes 1 of the ion guide or mass analyser 7 so that adjacent electrodes are preferably maintained at opposite phases of the applied AC or RF voltage.

The time of flight of ions through the preferred ion guide or mass analyser 7 is preferably described by the following equation:

$$T \propto C\sqrt{\frac{m}{q \cdot V^*}} \tag{3}$$

wherein q is the electron charge, m is the mass of the ion, C is a constant related to the distance over which the ions travel and V* is the time averaged axial potential difference or pseudo-potential difference.

The pseudo-potential may be described by:

$$V^* = \frac{q \cdot E(z)^2}{4m\sigma^2} \tag{4}$$

wherein E(z) describes the electric field in the axial direction for the maxima of the applied oscillating voltage and σ is the frequency of modulation.

From Eqn. 4 it is apparent that the time of flight given in Eqn. 3 above may be re-written as:

$$T \propto C\sqrt{\frac{m^2}{q^2}} = C \cdot \frac{m}{q} \tag{5}$$

An expression for the mass resolution R* of the mass analyser may be derived by differentiation of Eqn. 5:

$$R^* = \frac{m}{\partial m} = \frac{T}{\delta T} \tag{6}$$

It should be noted that the resolution of the preferred ion guide or mass analyser 7 as given in Eqn. 6 above is different to the relationship for ions accelerated in a DC potential which is given by Eqn. 7 below:

$$R = \frac{m}{\partial m} = \frac{T}{2\delta T} \tag{7}$$

It should also be noted that the pseudo-potential driving force according to the preferred embodiment acts equally upon positive and negative ions and urges ions in the same direction irrespective of whether an ion is positively or negatively charged. This is in contrast to an arrangement wherein a static or DC potential is used to drive ions through an ion guide wherein the DC potential will accelerate positive ions in the opposite direction to negative ions.

If a buffer gas is introduced into the preferred ion guide or mass analyser 7 then the time of flight of ions through the ion guide or mass analyser 7 may then become at least partially dependent upon the mobility of the ions. The mobility of an ion is a function of the cross sectional area of the ion, the buffer gas number density, the charge of the ion, the mass of the ion, the mass of the gas molecules and the temperature.

The various parameters and relationships which govern the separation of ions having differing mass to charge ratios and cross sections in an ion guide or mass analyser 7 according to the preferred embodiment are more complicated than those which apply with a conventional ion mobility drift tube wherein a DC potential is employed to accelerate ions through a buffer gas. In the case of a known ion mobility drift tube wherein a linear DC electric field is maintained along the length of the drift tube, then the equation motion of an ion may be expressed as:

$$z'' + \frac{\lambda z'}{m} - \frac{E \cdot q}{m} = 0 \tag{8}$$

wherein E is a field constant and λ is a drag term related to the cross sectional area of the ion, the gas number density, the cross sectional area and the temperature.

Considering the case where ions undergo sufficient collisions within the drift tube such that they reach a terminal velocity u:

$$\frac{\lambda u}{m} = \frac{E \cdot q}{m} \tag{9}$$

For a given length of drift tube L, the drift time Dt of an ion having a charge q and a mobility λ will be given by:

$$Dt = \frac{L \cdot \lambda}{E \cdot q} \tag{10}$$

In the case where according to the preferred embodiment ions are subjected to an axial pseudo-potential driving force V* (see Eqn. 4 above) then Eqn. 10 above is modified:

$$Dt^* = \frac{L \cdot \lambda \cdot m}{A \cdot q^2} \tag{11}$$

wherein A is the field constant of the axial pseudo-potential.

It is apparent that the drift time Dt* is proportional both to the mobility λ of an ion and the mass m of an ion for ions having the same charge q.

Figure 4:
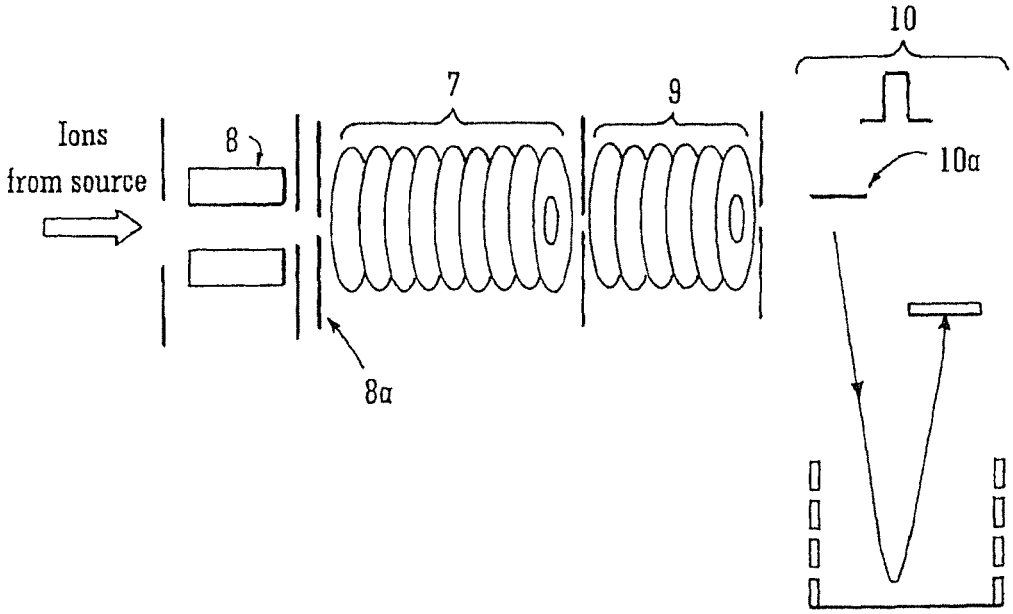
FIG. 4 shows a mass spectrometer according to an embodiment of the present invention wherein a preferred Time of Flight mass analyser is coupled to an orthogonal acceleration Time of Flight mass analyser via an ion guide.

FIG. 4 shows an embodiment of the present invention wherein a preferred ion guide or mass analyser 7 is arranged upstream of an orthogonal acceleration Time of Flight mass analyser or mass spectrometer 10. Ions from an ion source are preferably accumulated in an ion trap or ion trapping region 8 which is preferably arranged upstream of the preferred ion guide or mass analyser 7. Ions are preferably pulsed out of the ion trap or ion trapping region 8 into the preferred ion guide or mass analyser 7 by altering the potential or voltage applied to a gate electrode 8*a*. The gate electrode 8*a* is preferably arranged downstream of the ion trap or ion trapping region 8 and upstream of the preferred ion guide or mass analyser 7.

At a time T0 the magnitude of a supplemental, secondary or additional axial AC or RF voltage or potential which is preferably applied to the electrodes of the preferred ion guide or mass analyser 7 is preferably relatively low or zero. Once ions have entered the preferred ion guide or mass analyser 7 at a subsequent time T1 (wherein T1>T0), the magnitude or amplitude of the supplemental, secondary or additional AC or RF voltage or potential is preferably increased to a maximum value.

According to an embodiment the maximum amplitude of the supplemental, secondary or additional AC or RF voltage or potential preferably decreases from the entrance region, entrance electrode or entrance aperture of the preferred ion guide or mass analyser 7 towards the exit region, exit electrode or exit aperture of the preferred ion guide or mass analyser 7 in a non-linear manner. As discussed above, the transit time of ions through the preferred ion guide or mass analyser 7 is preferably related to the mass to charge ratio of the ions and the field parameters of the ion guide or mass analyser 7.

According to an embodiment a travelling wave ion guide 9 or a second ion guide may be arranged downstream of the preferred ion guide or mass analyser 7. The travelling wave ion guide 9 or second ion guide is preferably arranged to sample the ions output from or which emerge from the preferred ion guide or mass analyser 7. Ions having a restricted or a relatively narrow range of mass to charge ratios preferably emerge from the preferred ion guide or mass analyser 7 at any instance in time. The ions which emerge at any instance in time are then preferably arranged to be received in one of a number of axial potential wells which are preferably created and then translated along the length of the travelling wave ion guide 9 or second ion guide. One or more transient DC voltages or potentials or one or more transient DC voltage or potential waveforms are preferably applied to the electrodes of the travelling wave ion guide 9 or second ion guide so that one or more axial potential wells are preferably continually transported or translated along the length of the travelling wave ion guide 9 or second ion guide. Ions are preferably released from an axial potential well which has been translated along the length of the travelling wave ion guide 9 or second ion guide as the axial potential well reaches the downstream end of the travelling wave ion guide 9 or second ion guide.

Ions which are released from the travelling wave ion guide 9 or second ion guide preferably pass or are onwardly transmitted to an orthogonal acceleration Time of Flight mass analyser 10 which is preferably arranged downstream of the travelling wave ion guide 9 or second ion guide. An orthogonal extraction pulse or voltage is preferably periodically applied to an extraction electrode or pusher and/or puller electrode 10*a* of the orthogonal acceleration Time of Flight mass analyser 10. The orthogonal extraction pulse or voltage is preferably applied in a substantially synchronised manner with the release of ions from the travelling wave ion guide 9 or second ion guide. According to this embodiment, ions released from an axial potential well of the travelling ion guide 9 or second ion guide are preferably transmitted to the orthogonal acceleration region of the Time of Flight mass analyser 10 and are then orthogonally accelerated into the drift region of the Time of Flight mass analyser 10 in a substantially optimal manner.

According to an embodiment a buffer gas may be introduced into the preferred ion guide or mass analyser 7. According to this embodiment the output of ions from the preferred ion guide or mass analyser 7 may be at least partially related to the mobility of the ions in the buffer gas (see Eqn. 11).

Figure 4B:
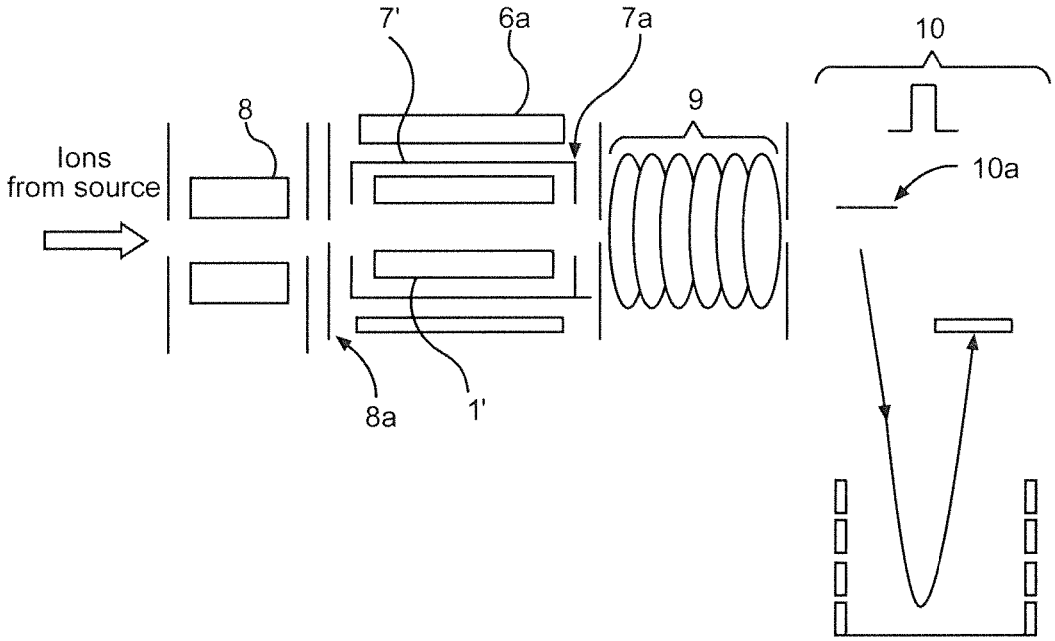
FIG. 4B shows a mass spectrometer according to an embodiment of the present invention wherein a preferred Time of Flight mass analyser is coupled to an orthogonal acceleration Time of Flight mass analyser via an ion guide.

According to the preferred embodiment the ion guide comprises a plurality of ring electrodes. This embodiment is particularly advantageous since different AC or RF voltages can be applied to different axial segments. However, according to another embodiment the ion guide or mass analyser may be used in a mode of operation as a collision gas cell 7*a* in a tandem mass spectrometer as shown in FIG. 4B. According to other less preferred embodiments the ion guide may comprise an elongated RF multipole rod set ion guide 7' such as a quadrupole rod set ion guide 7'. No axial electric field is developed as a result of applying an AC or RF voltage to the rod electrodes 1' in order to confine ions radially within the rod set ion guide 7'. The multipole rod set ion guide 7' may be axially segmented thereby enabling a supplemental, secondary or additional AC, RF or time varying voltage to be applied individually to the axial segments so that a non-zero axial inhomogenous pseudo-potential force is preferably generated along the length of ion guide 7'.

According to another embodiment, one or more auxiliary shaped electrodes 6*a* may be used to create an axial pseudo-potential driving force. The one or more auxiliary electrodes 6*a* may be located external to the multipole rod electrodes 1'. The one or more auxiliary electrodes 6*a* may be supplied with a supplemental, secondary or additional AC, RF or time varying voltage which is preferably independent of the AC or RF voltage which is preferably applied to the multipole rod electrodes l' in order to confine ions radially within the ion guide 7'. The one or more auxiliary electrodes 6*a* may be situated between the rod electrodes l' in regions of zero potential. The one or more auxiliary electrodes 6*a* may be shaped to produce the required axial field. According to another embodiment the one or more auxiliary electrodes 6*a* may be segmented axially so that different amplitudes of the supplemental, secondary or additional AC or RF voltage may be applied to individual segments.

According to an embodiment a DC voltage may additionally be applied to the one or more auxiliary electrodes 6*a* so that a smoothly varying potential or a travelling wave voltage or potential may be created which preferably manipulates or urges ion populations within the ion guide 7' and which preferably translates ions along the length of and through the ion guide 7'.

Figure 5:
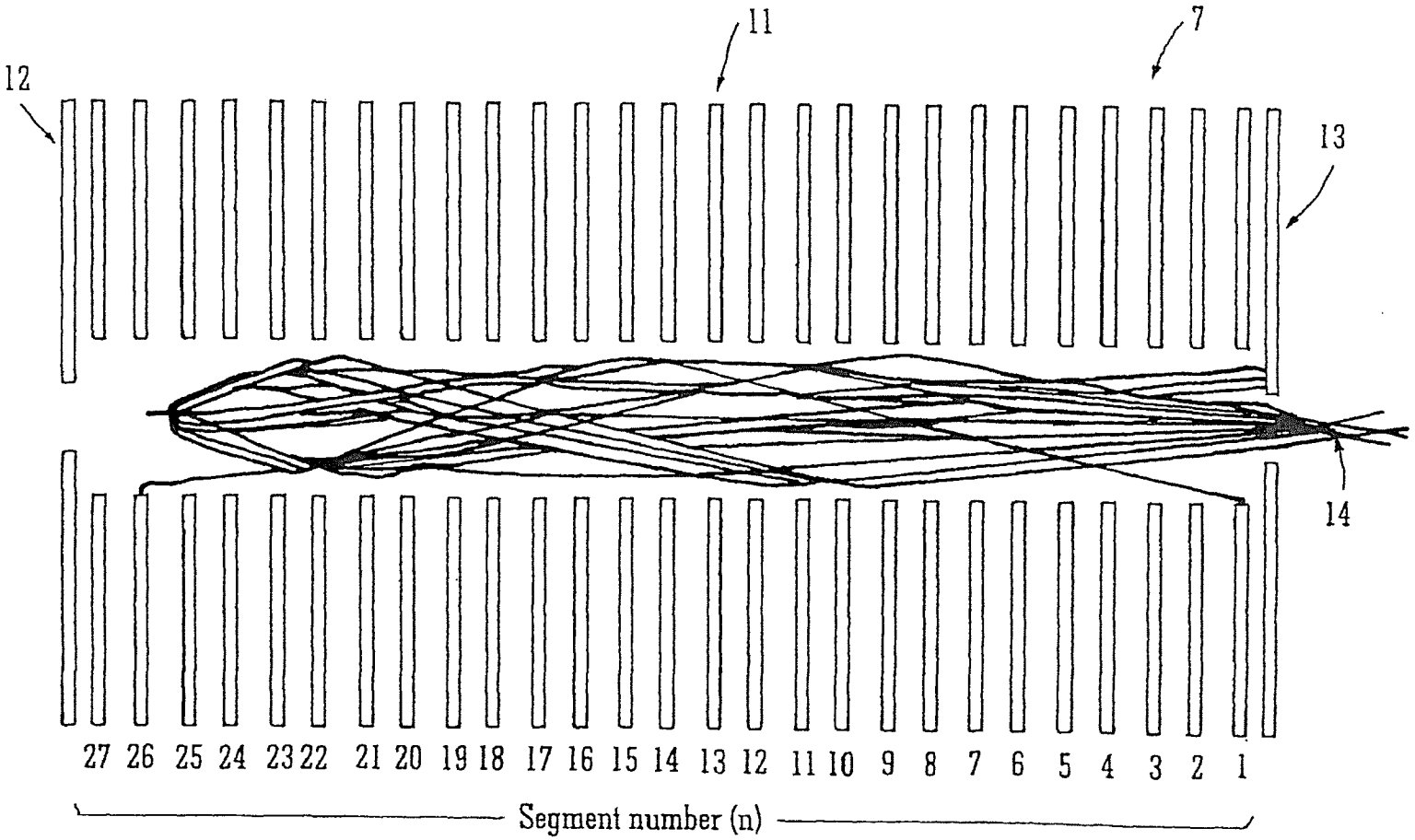
FIG. 5 shows the result of a SIMION® simulation of the trajectories of ten ions having mass to charge ratios of 500 which were modelled as entering a reflectron Time of Flight mass analyser wherein a supplemental, secondary or additional AC or RF potential was maintained along the length of the mass analyser but wherein ions were not confined radially within the mass analyser.

FIG. 5 shows the trajectories of ions in an ion guide or mass analyser 7 as modelled using SIMION® ion optics software. The ion guide or mass analyser 7 was modelled as comprising 27 ring or annular electrodes 11 wherein the radius inscribed by the ring or annular electrodes 11 was set at 2.5 mm. The ring or annular electrodes 11 each had a thickness of 0.5 mm and were modelled as having 1 mm gaps between adjacent electrodes 11. At either end of the ion guide or mass analyser 7 an annular end plate electrode 12, 13 was modelled as being provided. The annular end plate electrodes 12, 13 were modelled as having an internal radius of 1 mm and were modelled as being set or maintained at ground potential.

A supplemental, secondary or additional AC or RF voltage or potential was modelled as being applied to the electrodes 11 so that neighbouring electrodes were maintained at the same phase of the AC or RF voltage. The amplitude of the supplemental, secondary or additional AC or RF voltage was modelled as varying along the length of the ion guide or mass analyser 7. The amplitude of the supplemental, secondary or additional AC or RF voltage or potential applied to each of the n ring electrodes $V_{ax}(n)$ was modelled as following the following general relationship:

$$V_{ax}(n) = \frac{V_0 \cdot n^{\frac{3}{2}}}{27^{\frac{3}{2}}} \cos(\sigma t) \tag{12}$$

wherein $V_0$ is the maximum peak amplitude of the supplemental, secondary or additional AC or RF voltage applied to electrode #27 and $\sigma$ is the frequency of oscillation of the applied supplemental, secondary or additional AC or RF voltage or potential.

The relationship given in Eqn. 12 above was chosen such that the magnitude of the axial driving pseudo-potential was arranged to vary linearly along the length of the ion guide or mass analyser 7. However, according to other embodiments the axial pseudo-potential may be arranged to vary in another manner along the length of the ion guide or mass analyser 7.

The maximum amplitude $V_0$ as referred to in Eqn. 12 above was set at 800 V. The oscillating frequency σ of the supplemental, secondary or additional AC or RF voltage was set at 1 MHz.

The trajectories of ten ions each having a mass to charge ratio of 500 were simulated. Each ion was arranged to have an initial energy of 1 eV and the ions were arranged to have a spread of initial starting positions and trajectories. No gas model was used in the simulation. In the case of the simulation, the results of which are shown in FIG. 5, the ions were not confined radially within the ion guide or mass analyser 7 (i.e. a two-phase AC or RF voltage was not modelled as being applied to the electrodes 11). The ions were simulated as entering the ion guide or mass analyser 7 at an entry position 14. As the ions traverse the length of the ion guide or mass analyser 7 the ions move off or away from the central axis of the ion guide or mass analyser 7. Some of the ions come into close proximity with the electrodes 11. In the simulation shown in FIG. 5 only four of the ten ions which were modelled as initially entering the ion guide or mass analyser subsequently emerge from the ion guide or mass analyser 7 via electrode 13. The other ions hit the electrodes 11 within the ion guide or mass analyser 7 and are lost to the system.

Figure 6:
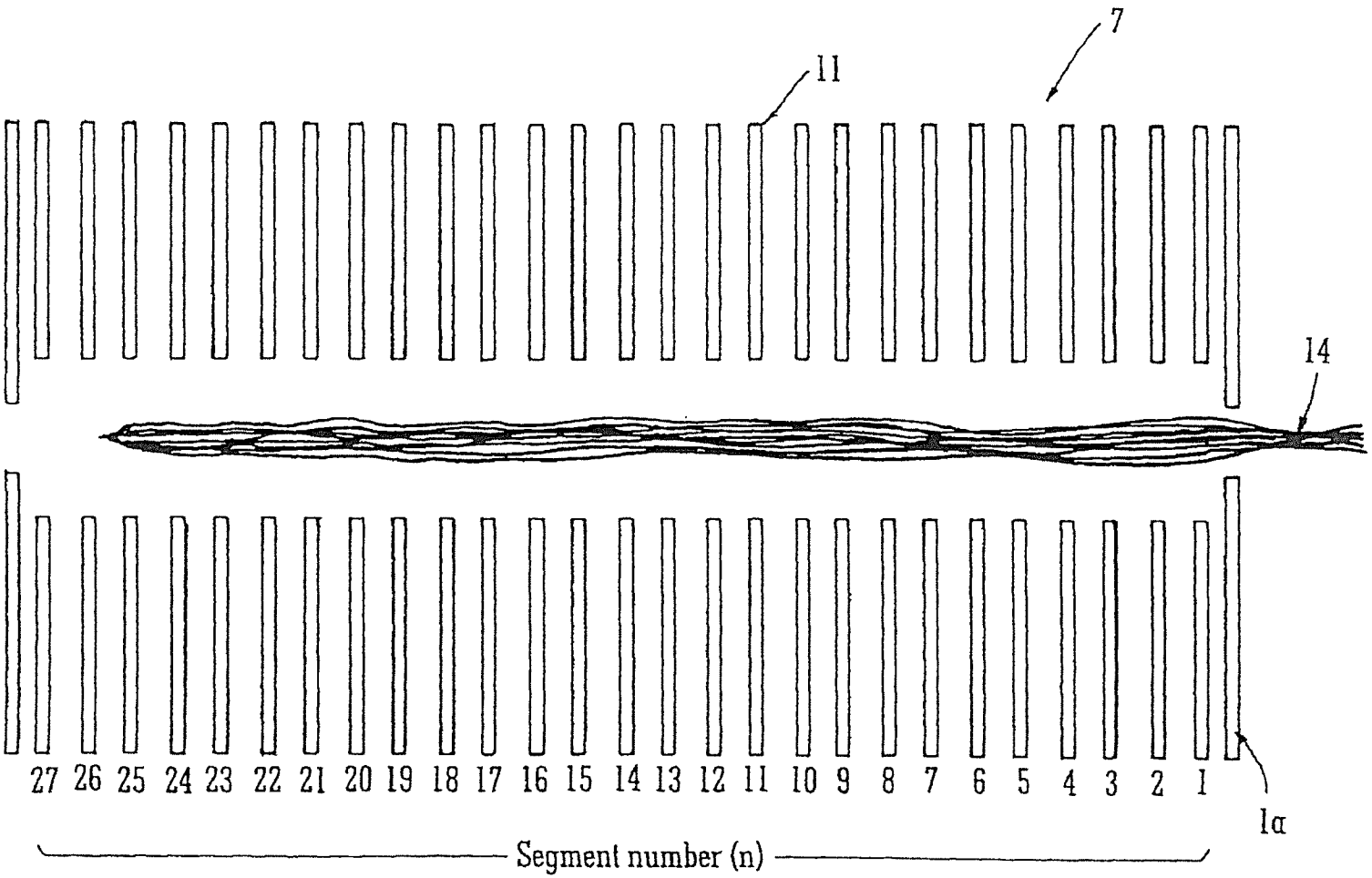
FIG. 6 shows the result of a SIMION® simulation of the trajectories of ten ions having mass to charge ratios of 500 which were modelled as entering a reflectron Time of Flight mass analyser wherein a supplemental, secondary or additional AC or RF potential was maintained along the length of the mass analyser and wherein ions were modelled as being confined radially within the mass analyser.

FIG. 6 shows the trajectories of ten ions which were modelled under similar conditions to those described above with reference to FIG. 5 but wherein the ions were modelled as being confined radially within the ion guide or mass analyser 7. In the simulation shown in FIG. 6, a two-phase AC or RF voltage having a peak amplitude of 50V was modelled as being applied to the electrodes 11. The frequency of the two-phase AC or RF voltage was set at 1 MHz. No gas model was used in the simulation. It is apparent from FIG. 6 that the ions were confined radially within the ion guide or mass analyser 7. The ions were confined to the central axis of the ion guide or mass analyser 7 more efficiently than in the case where no radially confining RF voltage was applied to the electrodes 11. In this example, all ten ions which initially entered the ion guide or mass analyser 7 at entry position 14 subsequently exit the ion guide or mass analyser 7 and hence may be detected.

Figure 7:
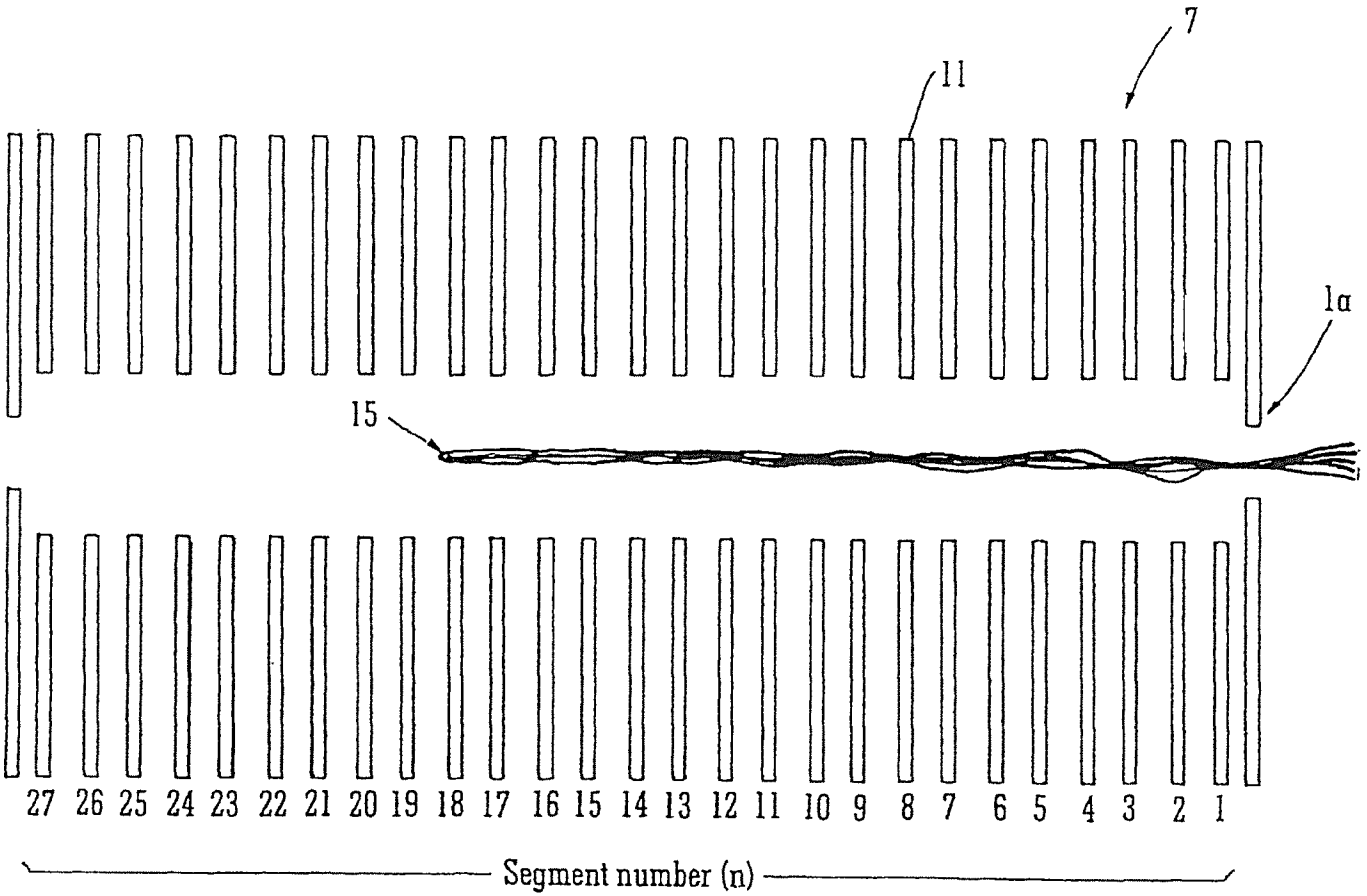
FIG. 7 shows a SIMION® simulation of the trajectories of five ions having mass to charge ratios of 500 which were modelled as being initially present within a Time of Flight mass analyser according to an embodiment of the present invention wherein ions were confined radially within the mass analyser and wherein a supplemental, secondary or additional AC or RF potential was modelled as being maintained along the length of the mass analyser and wherein the amplitude of the supplemental, secondary or additional AC or RF potential was modelled as increasing as a function of time.

FIG. 7 shows the results of a simulation according to a different embodiment of the present invention wherein ions were modelled as being confined radially within the ion guide or mass analyser 7 and wherein a supplemental, secondary or additional AC or RF voltage or potential was modelled as being applied to each of the ring electrodes 11. According to this embodiment the amplitude of the supplemental, secondary or additional AC or RF voltage or potential was modelled as increasing with time.

The peak amplitude of the two-phase AC or RF voltage which was applied to the electrodes 11 in order to confine ions radially was set at 200 V and had a frequency of 1 MHz. Neighbouring ring electrodes were maintained at opposite phases of the two-phase AC or RF voltage. The supplemental, secondary or additional AC or RF potential was modelled such that adjacent electrodes 11 experienced the same phase of the supplemental, secondary or additional AC or RF potential. The amplitude of the supplemental, secondary or additional AC or RF potential was arranged to vary along the length of the ion guide or mass analyser 7 both as a function of axial displacement and also of time. The amplitude of the supplemental, secondary or additional AC or RF voltage $V_{ax}$ (n) applied to each of the n electrodes was ramped from zero amplitude to a maximum amplitude over a period of time and was arranged to follow the following relationship:

$$V_{ax}(n) = \frac{V_0 \cdot n^{\frac{3}{2}}}{27^{\frac{3}{2}}} \cos(\sigma t) \cdot \frac{t}{10^{-3}} \tag{12}$$

wherein $V_0$ is the peak amplitude of the supplemental, secondary or additional AC or RF voltage applied to electrode #27 (see FIG. 7) and σ is the frequency of oscillation of the applied voltage.

In the simulation modelled in FIG. 7, the peak amplitude $V_0$ was set to 900 V and the oscillating frequency of the supplemental, secondary or additional AC or RF voltage a was set to 0.5 MHz. The voltage applied to the exit lens or exit electrode 1*a* was set to −2V.

Five ions having a mass to charge ratio of 500 were modelled as being initially present within the preferred ion guide or mass analyser 7 and located at a position 15. A hard sphere collision gas model was used to simulate a Helium buffer gas which was modelled as being present at a pressure of $1\times10^{-2}$ mbar within the preferred ion guide or mass analyser 7.

Ions cooled by the buffer gas were initially trapped within one of the axial pseudo-potential corrugations which result from the application of the two-phase AC or RF voltage or potential to the ring electrodes 11 in order to confine ions radially within the ion guide or mass analyser 7. As the amplitude of the axial driving RF potential was ramped or increased with time then ions were preferably driven through and along the preferred ion guide or mass analyser 7 towards the exit electrode 1*a*.

Figure 8:
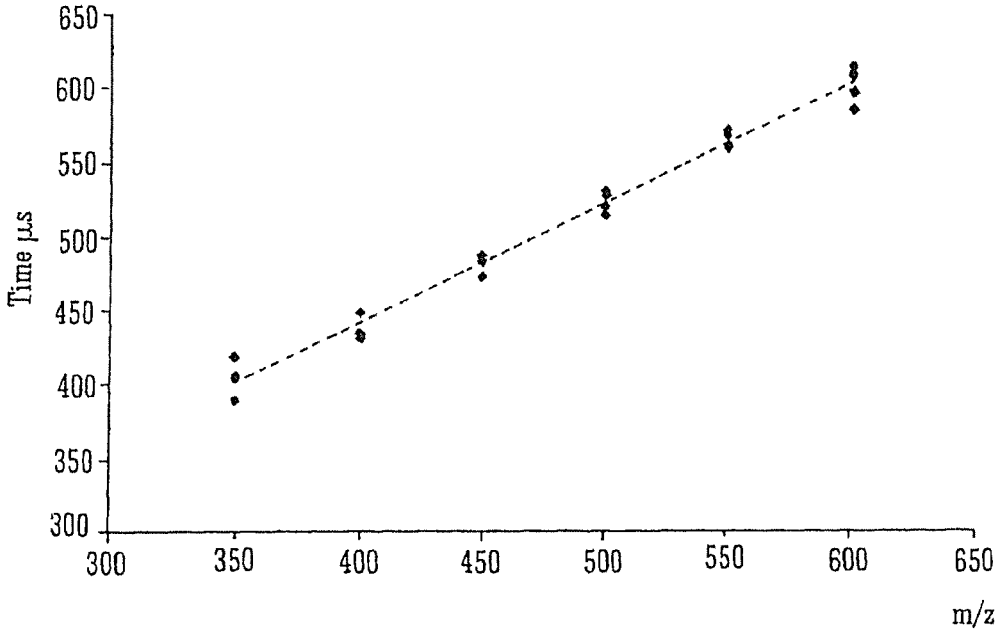
FIG. 8 shows a plot of the arrival time of ions as a function of mass to charge ratio for ions having different mass to charge ratios which were simulated as being initially present within a Time of Flight mass analyser as disclosed in relation to FIG. 7.

FIG. 8 shows a graph of the flight time of ions through a preferred ion guide or mass analyser 7 as modelled and described above in relation to FIG. 7. FIG. 8 shows the flight times of ions having mass to charge ratios of 350, 400, 450, 500, 550 and 600. Five ions were modelled at each mass to charge ratio. It can be seen from FIG. 8 that there is a linear relationship between the mass to charge ratio of the ions and the flight time. The linear relationship is in good agreement with the relationship described above by Eqns. 5 and 11.

Other embodiments are contemplated wherein the preferred ion guide or mass analyser 7 may be used with or coupled to other types of mass analysers. For example, the preferred ion guide or mass analyser 7 may be coupled to a scanning quadrupole rod set mass filter or mass analyser. According to this embodiment the duty cycle of the mass filter or mass analyser may advantageously be increased.

According to another embodiment the preferred ion guide or mass analyser 7 may be used in a mode of operation as a collision gas cell in a tandem mass spectrometer.

Other embodiments are also contemplated wherein a buffer gas may be arranged to flow through the preferred ion guide or mass analyser 7 in a direction which is preferably substantially opposite to the direction in which ions are preferably urged or propelled through the ion guide or mass analyser 7 by the pseudo-potential driving force.

Although the present invention has been described with reference to the preferred embodiments, it will be understood by those skilled in the art that various changes in form and detail may be made without departing from the scope of the invention as set forth in the accompanying claims.

The invention claimed is:

1. A mass spectrometer comprising:

a collision gas cell comprising an ion guide, wherein said ion guide comprises a plurality of electrodes; and one or more voltage supplies arranged and adapted to confine ions radially within said ion guide;

wherein an axial pseudo-potential ramp is formed, created or maintained along at least a portion of the axial length of said ion guide to propel, force or urge ions along the length of the ion guide.

2. A mass spectrometer as claimed in claim 1, wherein said ion guide comprises a multipole rod set.

3. A mass spectrometer as claimed in claim 2, wherein said multipole rod set comprises a quadrupole rod set.

4. A mass spectrometer as claimed in claim 2, further comprising one or more auxiliary electrodes that are arranged to create said axial pseudo-potential ramp.

5. A mass spectrometer as claimed in claim 4, wherein said axial pseudo-potential ramp is formed by the application of an RF voltage applied to the one or more auxiliary electrodes.

6. A mass spectrometer as claimed in claim 1, wherein one or more electrodes are used to create said axial pseudo-potential ramp, wherein said one or more electrodes are arranged or shaped so as to produce said axial pseudo-potential ramp.

7. A mass spectrometer as claimed in claim 1, wherein the mass spectrometer is a tandem mass spectrometer.

8. A mass spectrometer as claimed in claim 1, wherein said ion guide is coupled to a scanning quadrupole rod set mass filter or mass analyser.

9. A mass spectrometer as claimed in claim 1, wherein said axial pseudo-potential ramp causes, in use, ions within said ion guide to experience an axial pseudo-potential that propels, forces or urges ions along the length of the ion guide.

10. A mass spectrometer as claimed in claim 9, wherein said axial pseudo-potential urges ions in the same direction irrespective of whether an ion is positively or negatively charged.

11. A mass spectrometer as claimed in claim 1, wherein said axial pseudo-potential ramp is formed by the application of an RF voltage applied across the length of the ion guide.

12. A mass spectrometer as claimed in claim 1, wherein the magnitude of said axial pseudo-potential ramp experienced by an ion within said ion guide is mass to charge ratio dependent.

13. A mass spectrometer as claimed in claim 1, wherein said one or more voltage supplies comprises a first RF voltage supply arranged and adapted to apply a first RF voltage to said electrodes in order to confine ions radially within said ion guide.

14. A mass spectrometer as claimed in claim 13, wherein the maximum amplitude of said first RF voltage decreases along the length of the ion guide in a direction from an ion entrance region of said ion guide to an ion exit region of said ion guide.

15. A mass spectrometer as claimed in claim 13, wherein said first RF voltage supply is arranged and adapted to apply a second RF voltage to the electrodes forming said ion guide in order to generate said axial pseudo-potential ramp.

16. A mass spectrometer as claimed in claim 1, wherein a buffer gas is arranged to flow through the ion guide.

17. A mass spectrometer as claimed in claim 1, wherein said axial pseudo-potential ramp is formed by the application of a time-varying inhomogeneous axial electric field along at least a portion of the axial length of said ion guide.

18. A mass spectrometer as claimed in claim 17, wherein said time-varying inhomogeneous axial electric field decreases along the length of said ion guide in a direction from an ion entrance region of said ion guide to an ion exit region of said ion guide.

19. A mass spectrometer as claimed in claim 1, wherein said axial pseudo-potential ramp causes, in use, ions to accelerate axially along at least a portion of the axial length of said ion guide in a direction from an ion entrance region of said ion guide to an ion exit region of said ion guide.

20. A method of mass spectrometry, comprising:

arranging an ion guide in a collision gas cell, wherein said ion guide comprises a plurality of electrodes;

confining ions radially within said ion guide; and forming, creating or maintaining an axial pseudo-potential along at least a portion of the axial length of said ion guide that acts to propel, force or urge ions along the length of the ion guide.

* * * * *